US010507574B2

(12) United States Patent
Brandt

(10) Patent No.: US 10,507,574 B2
(45) Date of Patent: Dec. 17, 2019

(54) CONFINED ENTRY DEVICE

(71) Applicant: Justin Brandt, Aberdeen, SD (US)

(72) Inventor: Justin Brandt, Aberdeen, SD (US)

( * ) Notice: Subject to any disclaimer, the term of this patent is extended or adjusted under 35 U.S.C. 154(b) by 254 days.

(21) Appl. No.: 15/366,795

(22) Filed: Dec. 1, 2016

(65) Prior Publication Data

US 2017/0151663 A1 Jun. 1, 2017

Related U.S. Application Data

(60) Provisional application No. 62/261,426, filed on Dec. 1, 2015.

(51) Int. Cl.

| | |
|---|---|
| ***A62B 35/00*** | (2006.01) |
| ***B25H 5/00*** | (2006.01) |
| ***A47C 3/18*** | (2006.01) |
| ***A47C 7/00*** | (2006.01) |
| ***B66F 11/04*** | (2006.01) |
| ***A63B 21/05*** | (2006.01) |
| ***A63B 21/055*** | (2006.01) |

(52) U.S. Cl.

CPC ..... *B25H 5/00* (2013.01); *A47C 3/18* (2013.01); *A47C 7/006* (2013.01); *A62B 35/0068* (2013.01); *A63B 21/0557* (2013.01); *B66F 11/04* (2013.01)

(58) Field of Classification Search

CPC ..... A62B 35/0068; A62B 35/0081; E04G 21/3261; E04G 21/3276; E04G 21/3295; B25H 5/00; A47C 3/18; A47C 7/006; A47C 9/027; A47C 13/00; B66F 11/04; E01B 25/18; E01B 25/22; A63B 21/0557; A61B 5/0555

USPC ..... 482/142; 280/32.6; 182/36

See application file for complete search history.

(56) References Cited

U.S. PATENT DOCUMENTS

| | | | | |
|---|---|---|---|---|
| 4,185,846 | A * | 1/1980 | Black | B25H 5/00 280/11.115 |
| 4,271,762 | A * | 6/1981 | Wiegand | B62B 15/00 104/118 |
| 4,706,953 | A * | 11/1987 | Graham | A63B 21/0622 482/110 |
| 5,092,426 | A * | 3/1992 | Rhodes | A62B 35/0068 182/3 |
| 5,711,397 | A * | 1/1998 | Flora | A62B 35/0062 182/3 |
| 5,718,305 | A | 2/1998 | Palmer | |

(Continued)

*Primary Examiner* — Ryan D Kwiecinski

(74) *Attorney, Agent, or Firm* — Global Intellectual Property Agency, LLC; Daniel Boudwin

(57) ABSTRACT

A seat assembly. The seat assembly is adapted for use in entering confined spaces or otherwise entering spaces through confined entryways. The seat assembly includes a seat that is slidably disposed along a track. In one embodiment, the seat is rotatable. The seat assembly further includes a wire or tether that has multiple clamps positioned along its length. The assembly is utilized by placing the track such that it extends through a confined entryway and then securing the clamps about the perimeter edge of the opening such that the tether is held taut. The tension in the wire exerts a force that maintains the track, the seat, and a user or any equipment thereon in a horizontal position through the opening. Users can the utilize the slidable seat to enter and exit the confined opening with minimal difficulty.

9 Claims, 3 Drawing Sheets

(56) References Cited

U.S. PATENT DOCUMENTS

| | | | | |
|---|---|---|---|---|
| 6,227,553 | B1 * | 5/2001 | Palmer | A62B 35/0068 280/47.18 |
| 7,000,730 | B1 * | 2/2006 | Ostrobrod | A62B 1/04 182/36 |
| 7,743,710 | B2 * | 6/2010 | Gordon | B25H 5/00 104/2 |
| 8,261,878 | B2 | 9/2012 | Grome | |
| 8,708,099 | B2 | 4/2014 | Fortin | |
| 9,379,528 | B2 * | 6/2016 | Shaw | H02G 3/0456 |
| 2005/0051048 | A1 * | 3/2005 | Broek | B25H 5/00 104/106 |
| 2006/0032703 | A1 | 2/2006 | Burdet | |
| 2009/0095190 | A1 * | 4/2009 | Gordon | A63G 7/00 104/53 |
| 2009/0247376 | A1 * | 10/2009 | Merrithew | A63B 21/00 482/121 |
| 2012/0037451 | A1 | 2/2012 | Payne et al. | |
| 2012/0091673 | A1 * | 4/2012 | Meacham | B25H 5/00 280/32.6 |
| 2015/0065320 | A1 * | 3/2015 | Anderson | A63B 21/0428 482/142 |
| 2018/0319007 | A1 * | 11/2018 | Wilkinson | B66F 11/04 |

* cited by examiner

CONFINED ENTRY DEVICE

CROSS REFERENCE TO RELATED APPLICATIONS

This application claims the benefit of U.S. Provisional Application No. 62/261,426 filed on Dec. 1, 2015. The above identified patent application is herein incorporated by reference in its entirety to provide continuity of disclosure.

BACKGROUND OF THE INVENTION

The present invention relates to devices or systems for entering and working in confined spaces.

Confined spaces are defined as spaces that are large enough for a person to enter and work, but that are not designed for continuous occupancy and have limited or restricted means of entry and exit. When working within confined spaces, individuals must often wear personal protective equipment (PPE) and must carry specialized equipment with them for performing their tasks. Wearing bulky PPE and carrying equipment exacerbates the physical difficulty of entering and exiting a confined space through a narrow or restricted entryway. Furthermore, entering such confined spaces can also be dangerous if breathing regulators or other PPE components become caught or snagged on the entryway of the confined space. For these reasons, the Occupational Safety and Health Administration (OSHA) recommends that an entry supervisor oversee any work being performed in a confined space. However, there can still be substantial difficulty and danger associated with restricted entryways to confined spaces, whether or not an entry supervisor is assisting the individual or individuals entering the confined space. Therefore, there is a need in the art for devices that assist individuals in easily and safely entering and exiting a workspace through a confined entry.

SUMMARY OF THE INVENTION

In view of the foregoing disadvantages inherent in the known types of confined entry devices now present in the prior art, the present invention provides a device the same can be utilized for providing convenience for the user when entering or exiting a workspace through a confined entryway. The seat assembly is adapted for use in entering confined spaces or otherwise entering spaces through confined entryways. The seat assembly includes a seat that is slidably disposed along a track. In one embodiment, the seat is rotatable. The seat assembly further includes a wire or tether that has multiple clamps positioned along its length. The assembly is utilized by placing the track such that it extends through a confined entryway and then securing the clamps about the perimeter edge of the opening such that the tether is held taut. The tension in the wire exerts a force that maintains the track, the seat, and a user or any equipment thereon in a horizontal position through the opening. Users can the utilize the slidable seat to enter and exit the confined opening with minimal difficulty.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
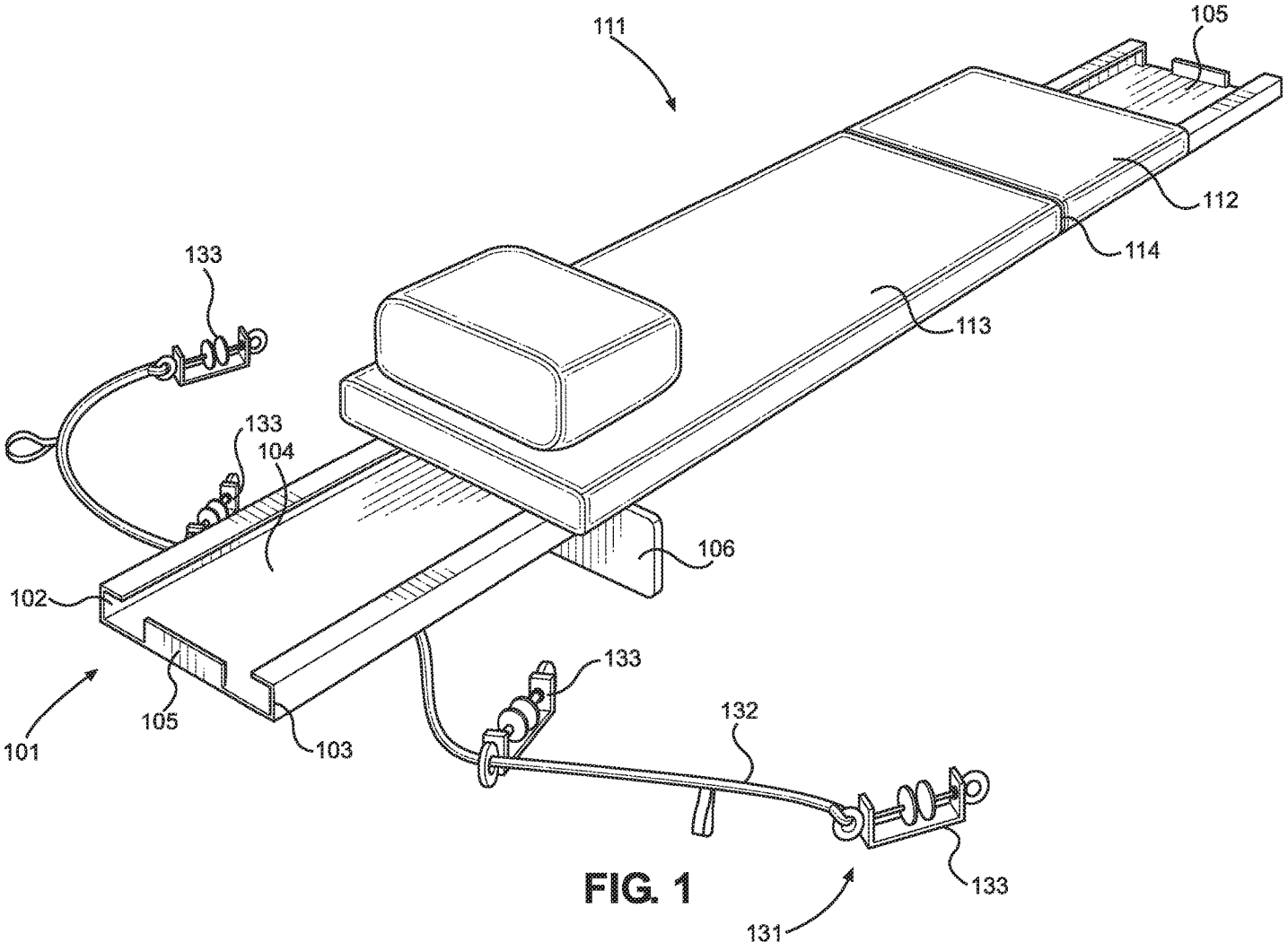
FIG. 1 shows a perspective view of a confined entry device.

Reference is made herein to the attached drawings. Like reference numerals are used throughout the drawings to depict like or similar elements of the confined entry device. The figures are intended for representative purposes only and should not be considered to be limiting in any respect.

Figure 2:
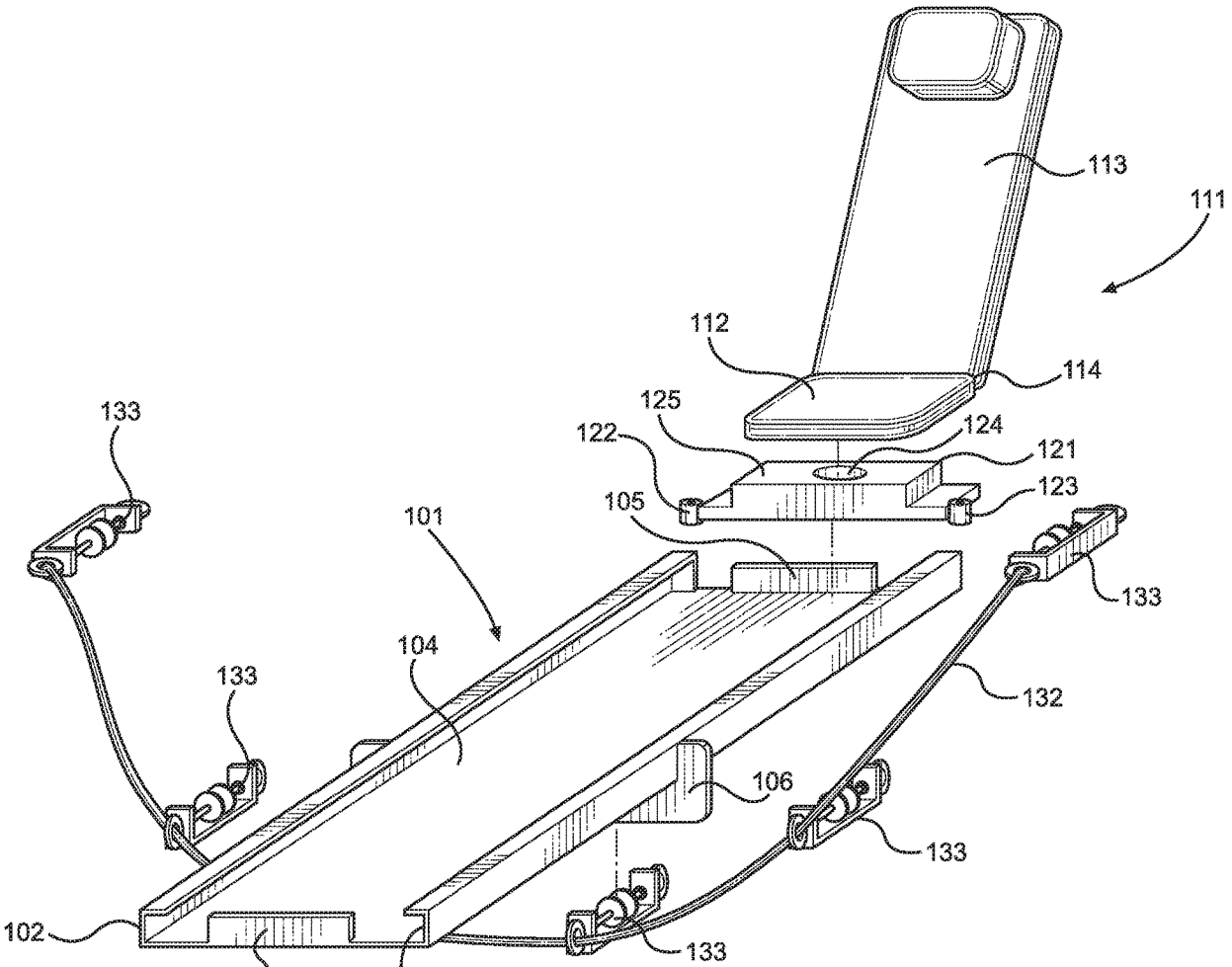
FIG. 2 shows a perspective exploded view of a confined entry device.

Referring now to FIGS. 1 and 2, there are shown a perspective view and an exploded perspective view of an embodiment of a confined entry device. The confined entry device is a seat assembly that is adapted for use in entering confined spaces or otherwise entering spaces through confined entryways. The confined entry device includes a track 101 along which a seat 111 is slidably positioned. The seat 111 has a length sufficient to support a human user thereon, allowing a user to lay on the seat 111 and slide between the distal ends of the track 101. In one embodiment of the confined entry device, the track 101 includes a first rail 102 and a second rail 103 with a planar section 104 extending therebetween. The first rail 102 and the second rail 103 are oriented parallel to each other and extend longitudinally along the length of the track 101. The track 101 is configured to engage a slider 121, which is interposed between the track 101 and the seat 111. The slider 121 is an intermediate component that slidably connects the seat 111 to the track 101.

The slider 121 includes rollers or wheels that engage and cooperate with the rails 102, 103 of the track 101. In an illustrative embodiment, the slider 121 includes a first roller 122 configured to engage with the first rail 102 and a second roller 123 configured to engage with the second rail 103. The slider 121 is sized and shaped such that it extends between the rails 102, 103 along the planar section 104 of the track 101, allowing the rollers 122, 123 to simultaneously engage the respective rails 102, 103. The slider 121 further includes a rotatable connector 124 disposed on its upper surface 125. The rotatable connector 124 is configured to engage the seat 111 and allow the seat 111 to rotate about the slider 121. In one embodiment, the rotatable connector 124 is configured to allow the seat 111 to rotate three hundred and sixty degrees. In one embodiment, the rotatable connector 124 is a cylindrical channel disposed on the slider 121 that is configured to receive a correspondingly sized and shaped projection or member extending from the undersurface of the seat 111. The channel allows for rotation of the projection therein, which in turn allows the seat 111 to rotate about the slider 121.

It should be noted that although the track 101 is depicted as including a pair of rails 102, 103 and the slider 121 is depicted as including a corresponding pair of rollers 122, 123, this embodiment is intended to be merely illustrative. Various embodiments of the device need only include at least one rail for the track 101 with which at least one corresponding roller disposed on the slider 121 engages.

In one embodiment, the track 101 includes a stop 105 disposed at each of the distal ends thereof. The stops 105 serve as physical barriers preventing the slider 121 from sliding beyond the track 101, which would otherwise result in the slider 121 disengaging from the track 101. In the depicted embodiment, the stops 105 are planar members extending perpendicularly from the distal edges of the track 101.

The seat 111 includes a first section 112 and a second section 113 that are joined by a pivotable connector 114. The pivotable connector 114 includes a mechanical hinge, a living hinge, or any other such connection that allows the second section 113 to pivot relative to the first section 112. The first section 112 is engaged with the slider 121 via the rotatable connector 124, allowing the seat 111 to rotate as an assembly.

The support assembly further includes a clamp assembly 131 positioned adjacently to one of the ends of the track 101, roughly perpendicular to the longitudinal axis of the track 101. The clamp assembly 131 includes a wire 132 or tether affixed to the track 101 and a plurality of clamps 133 fixedly positioned along the length of the wire 132. The wire 132 is positioned such that it is substantially perpendicular to the longitudinal axis of the track 101. By substantially parallel, what is meant is that the wire 132 is generally perpendicular to the track 101 when the wire 132 is laid flat, excepting minor variations in the position of the wire caused by the inherent flexibility of the wire 132. The wire 132 is also positioned on the track 101 such generally more towards one end of the track 101, thereby bifurcating the track 101 into two sections of uneven lengths. In use, the shorter section of the track 101 would be positioned exterior to the confined opening and the longer section of the track 101 would be positioned interior to the confined opening. This allows individuals to use the present device to slide themselves sufficiently deep into a workspace.

In one embodiment, one portion of the wire 132 is fixedly attached to the undersurface of the track 101. In one embodiment, the clamps 133 includes a clamp disposed at each of the distal ends of the wire 132 and one or more clamps disposed along the length of the wire 132 therebetween. The number of clamps 133 varies in different embodiments of the confined entry device though. The clamps 133 include G-clamps, hand screw clamps, quick grips, or any other such type of clamp known in the art.

Figure 3:
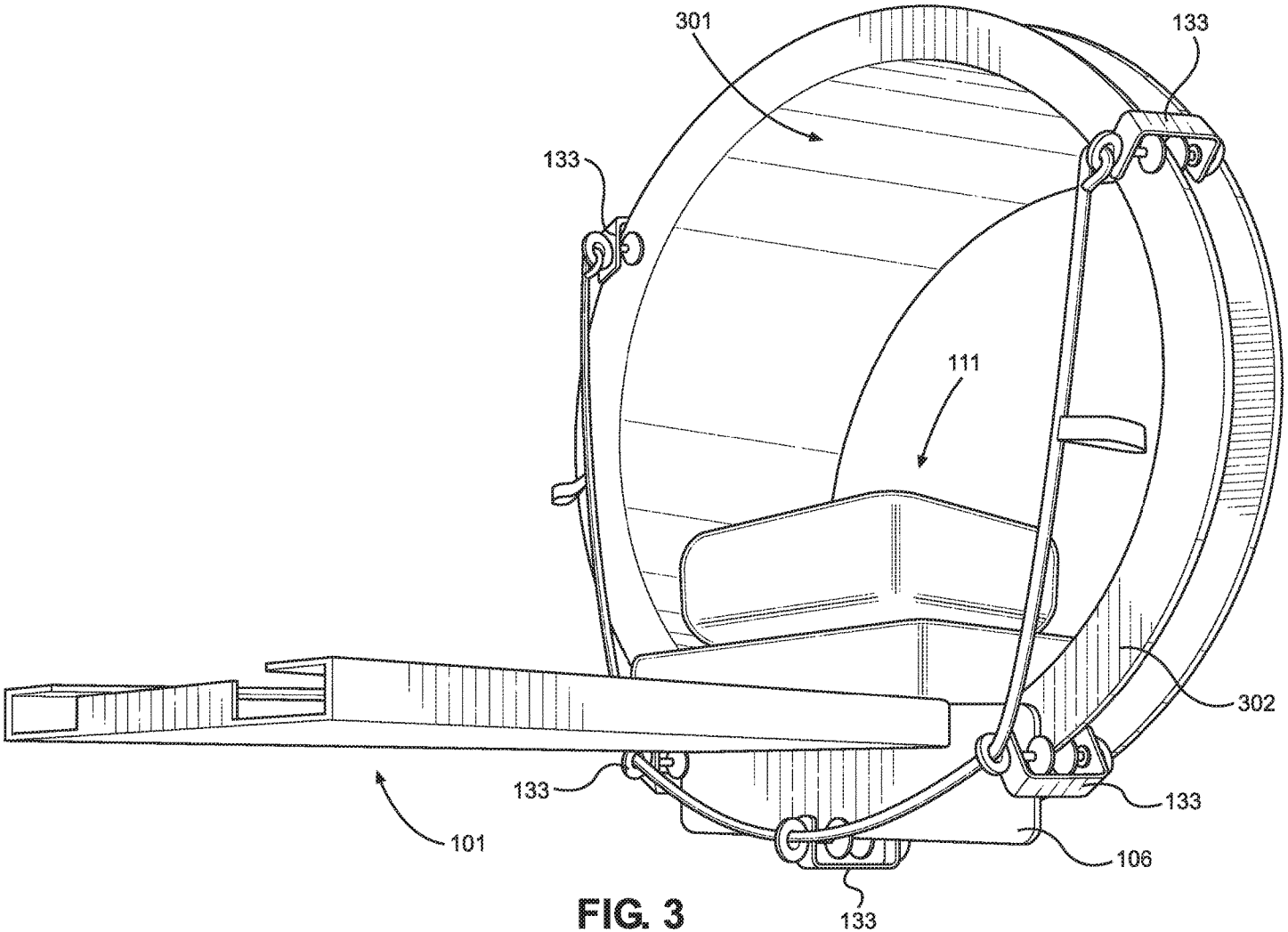
FIG. 3 shows a perspective view of a confined entry device attached to an opening.

Referring now to FIG. 3, there is shown a perspective view of a confined entry device attached to an opening. The confined entry device is utilized in conjunction with a confined opening 301 by first placing the track 101 through the opening 301, such that the seat 111 can slide from a first position at least partially exterior to the opening 301 to a second position interior to the opening 301 of the workspace. In use, the shorter section of the track 101, as determined by the wire 132 being positioned closer to one end of the track 102 than to an opposing end of the track 101, is intended to be positioned exterior of the opening 301. Accordingly, the longer section of the track 101 is intended to be positioned interior to the opening 301. In one embodiment, the confined entry device further includes a support plate 106 extending transversely across the undersurface of the track 101. The support plate 106 serves as an additional support resting against the edge 302 of the opening 301 and supporting the confined entry device thereagainst.

Once the track 111 is positioned through the opening 301, the clamps 133 can then be secured about the perimeter of the edge 302 of the opening 301. The clamps 133 should be secured so that the wire 132 is taut. The tension in the wire 132 exerts a force on the track 101 that supports the weight of the track 101, the seat 111, and an individual or any equipment thereon and maintains the track 101 in a horizontal position extending through the opening 301. Once the clamp assembly 131 is secured in place, a user can then lay on the seat 111 when it is extended at least partially exterior to the opening 301, lie down on the seat 111, slide the seat 111 along the track 101 until the user is interior to the opening 301 within the workspace, and then stand up from the seat 111 and begin work within the workspace. In embodiments wherein the seat 111 is rotatable, the user can exit the seat 111 via rotating it to a desired position and the standing up within the workspace. Once the user has stood up from the seat 111, the user can then slide the seat 111 so that it is once again exterior to the opening 301 so that additional individuals can then use the confined entry device to enter the confined workspace. When a user wishes to exit the confined workspace, the user simply lies down on the seat 111 and slides back out of the opening 301 along the track 101. The present device thereby allows users to utilize the slidable seat to enter and exit the confined opening with minimal difficulty.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A seat assembly for confined entry, comprising:

a track comprising a rail, the rail extending longitudinally along a length of the track;

a slider including a roller, the roller configured to slidably engage the rail;

a seat rotatably attached to the slider;

a wire attached to the underside of the track, the wire including a plurality of clamps disposed therealong, wherein the plurality of clamps comprise at least a clamp disposed at each end of the wire, wherein the plurality of clamps are configured to support the seat assembly.

2. The seat assembly of claim 1, wherein the plurality of clamps comprise at least a clamp disposed at each end of the wire and one or more clamps disposed therebetween.

3. The seat assembly of claim 1, wherein the plurality of clamps comprises G-clamps.

4. The seat assembly of claim 1, wherein the seat comprises a first section pivotably connected to a second section.

5. The seat assembly of claim 1, wherein the seat is configured to rotate 360-degrees.

6. The seat assembly of claim 1, further comprising a support plate disposed on an undersurface of the track, the support plate extending perpendicularly relative to the longitudinal axis of the track.

7. The seat assembly of claim 1, further comprising a stop disposed at each end of the track, the stop configured to prevent the slider from disengaging from the track.

8. The seat assembly of claim 1, wherein the rail is a first rail and the roller is a first roller, further comprising:

a second rail extending longitudinally along the length of the track;

a second roller disposed on the slider;

wherein the slider is configured to extend between the first rail and the second rail such that the first roller and the second roller slidably engage the first rail and the second rail, respectively.

9. The seat assembly of claim 1, wherein the wire is positioned closer to one end of the track than to an opposing end of the track.

* * * * *